United States Patent [19]

Prue, Jr. et al.

[11] Patent Number: 4,585,987

[45] Date of Patent: Apr. 29, 1986

[54] REGULATED VOLTAGE SUPPLY WITH SENSE CURRENT CANCELLATION CIRCUIT

[75] Inventors: Walter W. Prue, Jr., Bothel; Larry E. Eccleston, Edmonds, both of Wash.

[73] Assignee: John Fluke Mfg. Co., Inc., Everett, Wash.

[21] Appl. No.: 522,834

[22] Filed: Aug. 12, 1983

[51] Int. Cl.[4] ..... G05F 1/62

[52] U.S. Cl. ..... 323/275; 323/909

[58] Field of Search ..... 307/297; 323/909, 275, 323/246; 324/72.5, 76 R, 78 N, 402

[56] References Cited

U.S. PATENT DOCUMENTS

| | | | |
|---|---|---|---|
| 3,532,936 | 10/1970 | Kuster | 323/909 |
| 3,538,423 | 11/1970 | Goleniewski | 323/275 |
| 3,646,428 | 2/1972 | Torok | 307/297 |
| 3,723,854 | 3/1973 | Kita | 323/246 |
| 3,818,274 | 6/1974 | DeWitte et al. | 323/909 |
| 4,551,668 | 11/1985 | Kammiller | 323/909 |

FOREIGN PATENT DOCUMENTS

| | | | |
|---|---|---|---|
| 3211989 | 10/1983 | Fed. Rep. of Germany | 323/909 |
| 240763 | 8/1969 | U.S.S.R. | 323/275 |
| 469961 | 8/1975 | U.S.S.R. | 323/909 |

OTHER PUBLICATIONS

Hollingsworth, "Stabilized Power-Supply Characteristics and Facilities" *Electronics and Power,* Apr. 1984, pp. 311-314.

*Primary Examiner*—Patrick R. Salce
*Assistant Examiner*—D. L. Rebsch
*Attorney, Agent, or Firm*—James P. O'Shaughnessy; J. Robert Cassidy; Stephen A. Becker

[57] ABSTRACT

A regulated voltage supply (10) for delivering a substantially constant voltage to a load (12) having a regulator (24) for controlling a raw voltage supply (22) to deliver that constant potential, wherein the supply includes sense leads (28 and 30) between the load and the regulator for monitoring load voltage, provided with a sense current cancellation circuit (30) for nulling sense current and preventing it from flowing through the sense leads; in a preferred implementation, including voltage-to-current converters (42 and 44) bridging respectively the output terminals (14 and 16) and the sense terminals (32 and 34), it provides a cancellation current equal in magnitude and opposite in direction to the sense current.

9 Claims, 3 Drawing Figures

REGULATED VOLTAGE SUPPLY WITH SENSE CURRENT CANCELLATION CIRCUIT

DESCRIPTION

1. Technical Field

The present invention relates, generally, to regulated voltage supplies which include sense circuitry for monitoring load voltage and adjusting the output potential in response thereto; and, more especially, to an improved circuit for cancelling the effects of sense current which, otherwise, would contribute to lost accuracy. The present invention is widely adaptable for use in association with regulated voltage supplies, voltage calibrators, or other electrical devices/systems wherein the establishment of accurate potential and regulation is of paramount interest and which, in furtherance thereof, utilize sense circuitry.

2. DESCRIPTION OF BACKGROUND ART

All manner and variety of regulated voltage sources are now commonplace. In some cases such a regulated power supply may be essential for the delivery of a constant, meticulously regulated voltage to operate a load. In other cases, voltage calibrators are designed for the purpose which the name evokes, the development of an accurate reference voltage for calibration of equipment. While there may be other settings in which carefully controlled potential sources find good advantage, the two aforementioned constitute the principal applications for these devices. Regardless, in all cases it is an operational prerequisite that the voltage delivered be an accurate one; accuracy in these terms being measured of the order of parts per million as acceptable deviation (e.g., one part per million).

A conventional system wherein these regulated supplies find typical use will customarily associate the supply with, e.g., the load via leads for intercommunication with output terminals on the former. It is an accepted fact that the output leads possess a finite resistance which varies due to, inter alia, length, size, composition, and environmental factors. Regardless of this, these leads are in series with the load and, as current flows therethrough, will develop a measureable voltage drop (i.e., IR drop). The voltage drop within the output leads is subtractive from the load voltage and can, in many instances, exceed the acceptable tolerances for the regulated supply. In other words, the sum total of voltage developed across the effective connecting lead resistance of a regulated supply may exceed the deviation from established load requirements acceptable within the limits of accuracy thereof.

A common approach, with an eye toward factoring out the inherent voltage drops across output leads, is the incorporation of a sense circuit in electrical communication with the regulator portion of the supply. This regulator, typically a variable conductance device which controls a raw voltage supply, is provided with an input signal (directly or indirectly) indicative of load voltage which, in turn, operates upon the variable conductance regulator to alter its dynamic operating conditions and thereby maintain the desired load voltage without regard to any voltage drop across output connecting leads to the load. However, these sense leads too are characterized by an effective resistance in the same fashion as the connecting leads. Thus, sense current flowing through the sense leads will itself tend to contribute to error, notwithstanding a typically lower value for sense current vis-a-vis load current. In point of fact however, there are certain implementations where the incorporation of sense leads for the objective of improving accuracy in the delivered potential contributes to greater ultimate error than would be the case without this type of sense circuitry.

One historical method for overcoming error contribution as the consequence of sense circuitry has been external compensation. More specifically, with a given system ready for operation, compensation is made on the basis of external measurement. This ad hoc approach is a workable one in many instances; particularly useful where the adaptation is one calling for a constant potential which does not vary in a stable environment as concerns, for example, ambient considerations and the continual use of the same hardwiring for system interconnection. Where variations are to be anticipated, however, this task of measurement/compensation is, at best, tedious and prone to error. Then too, internal correction within the very supply would be viewed as a more preferred mode of operation than the need for repetitive adjustment in the nature of external compensation. To date, no such acceptable means for this type of internal correction has emerged in the art.

SUMMARY OF THE INVENTION

The present invention advantageously provides the ability to maintain a desired constant voltage across a load or other output delivered by a regulated supply having associated therewith means for sensing load voltage to monitor and maintain it within carefully controlled limits. The present invention provides yet another advantage of maintaining constant load voltage in the face of variations in that desired output potential, tracking deviations in the monitoring/sensing circuitry as well. Still another advantage is the ability of the present invention to achieve the noted regulation notwithstanding other environmental/implementation variables which would otherwise give rise to unacceptable loss of accuracy. Yet another favorable benefit of the present invention is the ability to incorporate generally conventional sense circuitry for monitoring output potential and achieving desired regulation without contributing the other sources of error as is oftentimes encountered due to sense current itself.

The foregoing, and other, advantages of the present invention are realized in one aspect thereof by a sense current cancellation circuit which provides a nulling current to offset current which would otherwise flow through the sense leads and, by virtue of the inherent effective resistance thereof, contribute to error. In a preferred form of the present invention, the cancellation current is generated in response to the monitored load voltage and nulls, by means of a selective path through current generator means, current which would otherwise flow through the sense leads with the concomitant potential for inaccurate operation. Elimination of that current in turn eliminates any voltage drop across the effective resistance of the sense leads whereby accurate sensing and related regulation of the output voltage may be achieved. Conceptually, it is envisioned that any current generator may be adapted for use in association with the sense cancellation circuit of the present invention. A preferred current generator is a voltage-to-current converter, the most preferred being a circuit known in the art as the "Howland circuit", operating with isolated power supplies. In that highly preferred form, sense current is swamped in the Howland circuit through the independent, isolated power supplies therefor.

The regulated voltage supply delivers a substantially constant voltage to a load which has regulator means for controlling output voltage. The voltage supply includes sense circuitry with leads in operative communication between the load and the regulator means for monitoring and controlling load voltage. The voltage supply comprises sense current cancellation means for nulling sense current and preventing the same from flowing through the sense leads. The sense current cancellation means comprises a current generator for developing a cancellation current having an equal magnitude and opposite direction to the sense current. The current generator is a voltage to current generator which develops a variable cancellation current as a function of variations in load voltage. The regulator means comprises a raw voltage supply and series regulator means of variable conductance which has a control input from amplifier means communicating with the load and monitoring the load voltage through the sense leads. The sense leads are disposed from first and second sense terminals of the regulated voltage supply.

The invention also comprises a system having a regulated voltage supply for delivering a substantially constant voltage to a load disposed across supply outputs and sense circuitry means, including sense leads in communication across the load for monitoring load voltage and maintaining the same at a predetermined value. The system comprises a sense current cancellation circuit for developing a variable cancellation current as a function of the load voltage having a magnitude and direction for cancelling sense current and preventing the same from flowing through the sense leads. The system includes the regulated supply which has a raw supply means and regulator means for developing and delivering a constant potential across output high and output low terminals. The sense circuitry includes sense high and sense low terminals in effective communication with the regulator means. The system further comprises voltage-to-current converter means responsive to the load voltage for generating sense cancellation current and for providing a path through the raw supply via current bridging paths across the output and sense high terminals, and the output and sense low terminals. The system further comprises independent power supplies for the voltage-to-current converter wherein the voltage to current converter has a first input from the sense high terminal and a second input from the sense low terminal, and the power supplies have a common output to the output high terminal.

The invention also comprises a sense current cancellation circuit for nulling the sense current flowing through sense leads disposed intermediate a regulated voltage supply and a load electrically depending therefrom. The sense current cancellation circuit comprises current generator means in operative sensing communication with the load for monitoring load voltage and developing a cancellation current in response thereto equal in magnitude and opposite in direction to sense current.

Other advantages of the present invention, and a fuller appreciation of its design and mode of operation, will be gained upon an examination of the detailed description of preferred embodiments, taken in conjunction with the figures of drawing.

DETAILED DESCRIPTION OF PREFERRED EMBODIMENTS

The present invention relates, generally, to regulated voltage supplies which include sense circuitry for monitoring load voltage and adjusting the output potential in response thereto; and, more especially, to an improved circuit for cancelling the effects of current developed within the sense circuitry which, otherwise, would contribute to lost accuracy in the delivered output voltage. The present invention is widely adaptable for use in association with regulated voltage supplies, voltage calibrators, or other electrical devices wherein the accurate establishment of potential and regulation of same is of paramount interest; and, in furtherance thereof, utilize sense circuitry. Accordingly, the invention will now be described with reference to certain preferred embodiments within the aforementioned contexts; those skilled in the art will appreciate that such a description is meant to be exemplary only and should not be deemed limitating.

Figure 1:
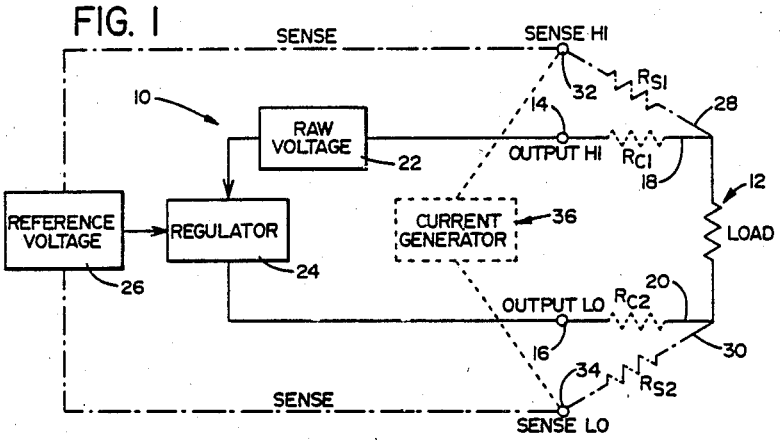
FIG. 1 is a schematic of a regulated voltage supply showing, in phantom lines, a generally conventional sense circuit but further including a block diagram of a sense current cancellation circuit in accordance with the present invention.

Turning to the figures, in each of which like parts are identified with like reference characters, FIG. 1 illustrates a regulated voltage supply system designated generally as 10 for providing a controlled voltage across a load designated generally as 12. The output voltage from supply 10 is coupled to load 12 by means of output high and output low terminals 14 and 16, respectively, communicating with the load via output connecting leads 18 and 20. The voltage supply 10 illustrated in FIG. 1 (in full lines) is of generally conventional design, including a raw voltage supply 22 and series regulator 24. The raw voltage supply 22 is constructed to provide a voltage at least equal to the desired load voltage ultimately to be applied across load 12, whereas the regulator 24 is typically a variable conductance device for maintaining that output voltage at a constant, predetermined level. Depending upon the design prerequisites, it is not at all uncommon for such a supply to be required to provide that constant voltage within an accuracy limit of only a few parts per million. Accordingly, the regulator includes means for varying its conductance (or gain, depending upon the precise implementation) in order to deliver the demanded load voltage within the predetermined limits of accuracy. In the illustrated circuit of FIG. 1, a reference voltage source 26 is provided to establish the dynamic operating characteristics of regulator 24 for that purpose.

The connecting leads 18 and 20 are required to span the outputs 14 and 16, respectively, and the load 12. These connecting leads may have an appreciable length or other physical/electrical parameter(s), giving rise to an appreciable effective resistance, shown schematically in FIG. 1 as $R_{C1}$ and $R_{C2}$, respectively. As current flows through the load in response to the applied voltage delivered via output terminals 14 and 16 to establish the desired constant voltage across the load, that selfsame current flowing in the series path through $R_{C1}$ and $R_{C2}$ will likewise create a voltage drop in each of these connecting leads. Due to the series connection, the collective voltage drops are substractive from that to be realized across the load 12. Even a few milliohms of resistance in each connecting lead can give rise to voltage drops which additively exceed the tolerance limits established for the supply 10 vis-a-vis the load 12. For example, if an output or load voltage of 10 volts at 0.5 amps is to be maintained constant within only a few parts per million, it is readily apparent that even one milliohm resistance in each of the connecting leads 18 and 20 will develop voltage drops more than an order of magnitude beyond the acceptable deviation at load 12. Of course, one may set a system in place and then by measurement offset the voltage discrepancies resultant from lead resistance, but that is not a favored approach.

One proposal for eliminating the effects of voltage drop across connecting leads is the incorporation of sense circuitry in operative communication with the regulator ultimately responsible for controlling the output voltage. FIG. 1 shows schematically, in dash-dot lines, that approach to the problem. In this instance, high and low sense leads 28 and 30, respectively, extend directly to the load 12 from high and low sense terminals 32 and 34. These sense terminals are in operative communication with the regulator 24, in this instance via the reference voltage source 26. Irrespective of the precise intercommunication in this regard, the objective is to monitor (viz., "sense") the load voltage directly without reference to any unwanted voltage drops across the connecting leads and alter the conductance of regulator 24 to bring the load voltage within the desired limits of accuracy. It is recognized, however, that even the sense leads themselves possess effective resistance, represented here as $R_{S1}$ and $R_{S2}$. Nevertheless, as the sense current flowing within that portion of the circuit is lower in value than the load current in almost all instances, the voltage drop experienced as a consequence of sense current is correspondingly much lower. However, there are many situations where even this lower sense current can be significant as respects load current flowing through an appreciable resistance posed by the sense leads, leaving an error in excess of the tolerable limits for load voltage. Again, this deviation from acceptable performance can be overcome by external compensation. Better, however, is a means within the voltage supply 10 itself for achieving this objective.

Along the aforementioned lines, the voltage supply 10 of FIG. 1 is shown to include a current generator 36 spanning or bridging the sense terminals 32 and 34. Functionally, current generator 36 is provided to develop a nulling current equal in magnitude and opposite in direction to the sence current in order to cancel the same and thereby eliminate anomalous results due to the inherent sense lead resistances $R_{S1}$ and $R_{S2}$. In the simplest case of a constant voltage source not susceptible to variation, the current generator 36 may simply be calibrated with reference to the unchanging and measureable sense lead current for the purpose of developing the required cancellation or nulling current. However, practical demands on typical systems require more elegant approaches in order to take into account vagaries of operational demand.

Figure 2:
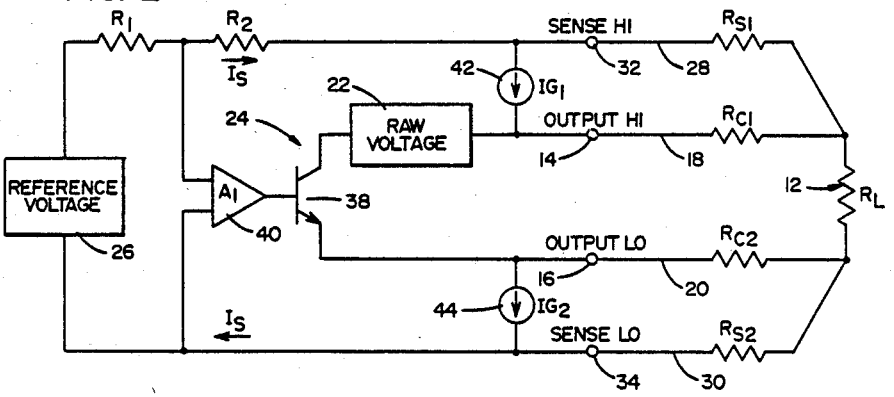
FIG. 2 is a schematic of a regulated voltage supply in accordance with the present invention, showing one embodiment of a sense current cancellation circuit; and, FIG. 3 is a more detailed schematic showing the most preferred implementation of the present invention, utilizing the Howland circuit and associated, isolated power supplies for swamping sense current and thereby preventing it from flowing through the sense leads.

FIG. 2 illustrates schematically one embodiment of the controlled voltage supply 10, including sense current cancellation circuitry in accordance with the present invention. As with the embodiment of FIG. 1, the load 12 is provided with a controlled raw voltage via connecting leads 18 and 20 which communicate with output high and output low terminals 14 and 16. The voltage developed in the raw voltage supply 22 is subject to variation through a voltage regulator 24. In this instance, the regulator 24 comprises a regulating transistor 38, the conductance of which is controlled by an amplifier 40. The gain of amplifier 40 is established, as is conventional, by means of reference voltage source 26 in conjunction with resistors $R_1$ and $R_2$; the gain of amplifier 40 (hence conductance of regulating transistor 38) being a function of the ratio of those resistances. Sense leads 28 and 30 provide operative communication between the load 12 and this regulating circuitry. In this embodiment, sense current $I_S$ flowing through resistor $R_2$ would typically follow a current path through the sense leads and, as a consequence thereof, develop voltage contributions in those leads due to the characteristic resistance of each, namely $R_{S1}$ and $R_{S2}$.

In this particular implementation of the present invention, that sense current $I_S$ is nulled by means of first and second current generators 42 and 44, respectively, which bridge the supply 10 the high side and low side internally. These current generators thereby provide an effective diversion for sense current $I_S$, yielding a path from $R_2$ through the first current generator 42, through the raw voltage supply 22 and associated regulating transistor 38, to the second current generator 44 and returning to the reference voltage source 26 via the common for the circuit. Hence, the sense current $I_S$ is prevented from flowing through the sense leads 28 and 30, in order to overcome the anomalous voltage drops otherwise associated therewith.

The current generators shown in FIG. 2, and embraced more generally in the block diagram of FIG. 1, may take any one of a number of different precise forms. The objective is to null sense current as a function of load voltage, including variations therein as one might expect with a variable source 10. The development of a cancellation current having a magnitude equal to the sense current, but in opposite directional sense thereto, is a functional objective irrespective of precise design. Accordingly, compensation circuitry including such devices as phototransistor(s) coupling a voltage-to-frequency converter and associated frequency-to-voltage converter may be utilized to this end. However, it has been determined that an implementation adapting the so-called "Howland circuit" is considered to be the most preferred implementation of the present invention. That embodiment is shown in FIG. 3, to which attention is now invited.

Figure 3:
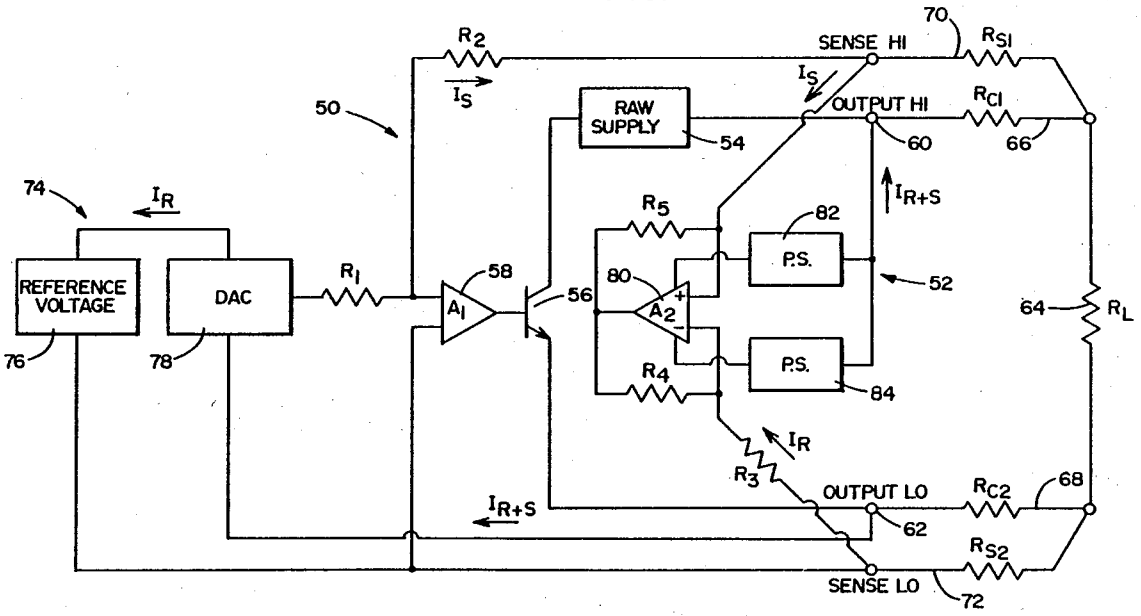

FIG. 3 shows a highly preferred embodiment of a regulated voltage supply, designated generally as 50, incorporating a sense current cancellation circuit in accordance with the present invention, designated generally as 52. The regulated supply includes a raw voltage supply 54, preferably one which has the ability to be varied over a preselected range of intended output voltages. The output current of supply 54 flows through a regulating transistor 56 having a variable conductance, determined by the output of a control amplifier 58. This gives rise to an impressed voltage across output terminals 60 and 62 of the supply 50. A load 64, represented as $R_L$, is disposed across the output terminals, communicating therewith by means of connecting leads 66 and 68. As described above, the output current responsible for the load voltage also develops voltage contributions within each of the leads 66 and 68 due to the inherent resistance of each, represented once again respectively as $R_{C1}$ and $R_{C2}$; the voltage drops within the leads being subtractive from the desired voltage across the load. In some situations, particularly those involving high current environments, the unwanted voltage drops across connecting leads is appreciable. Hence, as is generally conventional, the control amplifier 58 is disposed for sensing or monitoring the load voltage as opposed simply to sampling the output voltage across the terminals 60 and 62. For this purpose, sense leads 70 and 72 provide communication between the control amplifier and the load itself in order that the conductance of the regulating transistor 56 may be brought into conformity with the desired load voltage. Then, too, the sense leads are characterized by an inherent resistance, represented here once again respectively as $R_{S1}$ and $R_{S2}$. The voltage drop to be expected under most circumstances due to current flow through the sense leads is less than that arising by virtue of the resistance of the connecting leads insofar as the current through the former is usually considerably less than the current to be delivered through the connecting leads to the load; nonetheless, appreciable voltage drops beyond those which can be accepted in light of tolerance criteria may be encountered. It should also be appreciated that sense current can and will vary with output voltage, further complicating the ability to maintain close regulation over the desired potential impressed across the load 64.

A variable reference voltage for the supply 50 is provided by means of a reference divider network identified generally as 74. In this exemplary embodiment, the network comprises a reference voltage source 76 and a digital-to-analog converter ("DAC") 78. The reference voltage source 76 produces a current in the DAC 78, the function of which is to divide the reference and deliver an output voltage to the control amplifier 58 which varies in accordance with the digital word inputted to the DAC 78, which otherwise forms no part of the present invention. The variable reference voltage produces a variable current through a resistor $R_1$, identified here is $I_S$, which can vary from zero when the reference voltage is zero to a maximum at full scale output from the DAC. This current $I_S$ flows through the resistor $R_2$ which, in combination with $R_1$, sets the gain of the control amplifier 58. This current is that which would otherwise flow through the sense leads and contribute to error were it not for the cancellation circuit 52; following a path through the high sense lead, the high output connecting lead, back through the raw supply and regulating transistor, through the output low connecting lead, and thence back through the sense low lead. The cancellation circuitry 52 effectively nulls that current to eliminate error to which it may contribute.

The cancellation circuit 52 is shown bridging the sense terminals of the supply 50 at interconnections with the sense leads 70 and 72. The circuit includes an amplifier 80 operating in concert with independent power supplies 82 and 84, the latter having a common connection to the output high terminal 60. This arrangement is an adaptation of the known Howland circuit and is designed to swamp out the contributions of sense current $I_S$ as developed by the DAC 78 in its variable control over amplifier 58 and $I_R$ as developed upon the cooperation of the reference voltage source 76 and DAC 78 in the latter's division of the reference voltage for that selfsame purpose.

The negative input of the amplifier 80 is shown to be connected to the sense low output terminal via a resistor $R_3$ (albeit, equivalent impedance devices could equally well be employed). The value of $R_3$ is chosen to produce a current equal to $I_R$ at a maximum output voltage, corresponding to the current flowing through the DAC 78 during its division of the reference voltage. The positive input of the amplifier 80 is connected directly to the sense high terminal without intervening elements. As an operational amplifier, it maintains both the positive and negative terminals at the same voltage when the amplifier loop is stable. Accordingly, the negative terminal is forced to the voltage existing at the high sense lead. Consequently, the voltage across resistor $R_3$ corresponds to the output voltage as well, allowing for ease of calculation to insure that full scale operation yields a current flow equal to $I_R$. The current flow through resistor $R_3$ is then directed through resistor $R_4$ disposed across amplifier 80 and that contribution of sense current is sunk through the power supply network. The value of $I_S$ is likewise a known parameter from the design of the overall system. This current is diverted from the sense high terminal to the amplifier 80 through a resistor $R_5$ to the output side thereof. Knowing the value $I_S$ from design criteria and establishing the voltage across the amplifier 80 then allows the determination of the proper value of resistance for $R_5$ to insure that it provides the proper current flow, also to be sunk through the amplifier and power supply network.

As an operational example, let it be assumed that the desired load voltage is 10 volts; realistic values for the reference current $I_R$ being 200 microamps and the remaining contribution or portion of sense current $I_S$ being 500 microamps. At a full scale output of 10 volts applied across amplifier 80, the values of resistors $R_3$ and $R_4$ are easily chosen to insure a current flow through that path of 200 microamps to be sunk through the amplifier and power supply system. The 500 microamp contribution of $I_S$ must likewise be sunk. Knowing that and the further fact that there is a 10 volt potential across resistor $R_5$, its value is readily ascertainable (i.e., 20K). Subsequent variation in output voltage will affect that potential across the pulling network, but the sense current is likewise altered; the ratio corresponding such that the resistance values will nonetheless maintain this cancellation function.

As opposed to sense current flow through the leads 70 and 72, the respective contributions $I_R$ and $I_S$ are nulled by the voltage-to-current converter of the cancellation circuitry 52. Each is swamped separately through the negative and positive terminals of the amplifier 80 and the associated power supplies to recombine and flow to the output high terminal 60. From there, this current is directed through the raw supply 54 and regulating transistor 56 to the output low terminal 62, thence to DAC 78 to complete the current loop. None of this current flows within the sense leads 70 and 72 and, consequently, no error contribution is realized as a result.

While the invention has now been described with reference to certain preferred embodiments and exemplified in respect thereto, those skilled in the art will appreciate that various substitutions, modifications, changes and omissions may be made without departing from the spirit thereof. Accordingly, the foregoing description is meant to be illustrative only and should not be deemed limitative of the scope of the claims granted herein.

We claim:

1. A regulated voltage supply comprising:

a. regulator means in operative communication with a load for controlling output voltage across said load;

b. sense lead means connected between said load and said regulator means for sensing the magnitude of said output voltage and, in response, controlling said regulator means, a sense current flow in said sense lead means inducing a voltage drop in said sense lead means, tending to create an output voltage magnitude error; and c. current means for generating a compensating current through said sense lead means, said compensating current being substantially equal in magnitude and opposite in direction to said sense current to reduce said output voltage magnitude error.

2. The regulated voltage supply as set forth in claim 1 wherein said sense lead means comprises first and second sense leads establishing conductive paths between opposite ends of said load and said regulator means, respectively.

3. The regulated voltage supply as set forth in claim 1 wherein:

a. said sense lead means has an effective resistance which develops a first voltage drop across said effective resistance when said sense current flows through said sense lead means; and b. said compensating current causes the reduction of said sense current to reduce said voltage drop.

4. A regulated voltage supply comprising:

a. regulator means, in operative communication with a load, for controlling output voltage across said load;

b. means, for sensing said output voltage including (i) a first sense lead operatively connected between said load and a first point operativey connected to said regulator means, and (ii) a second sense lead operatively connected between said load and a second point operatively connected to said regulator means; and c. current means including amplifier means having an output, first and second inputs, and respective first and second resistive means operatively connected between said output and said first and second inputs, respectively, (i) said first point operatively connected to said first input to conduct a first compensating current therebetween, said current means characterized in that said first compensating current is substantially equivalent and opposite in direction to a first current flowing between said regulator means and said first point to reduce flow of said first current through said first sense lead, (ii) said second point operatively connected to said second input to conduct a second conpensating current therebetween, said current means characterized in that said second compensating current is substantially equivalent and opposite in direction to a second current flowing between said regulator means and said second point, to reduce flow of said second current through said second sense lead.

5. The regulated voltage supply as set forth in claim 4 wherein:

a. said second input is operatively connected to said second point by means of third resistive means, the value of said third resistive element selected to produce a value of said second compensating current substantially equivalent to said second current; and b. the value of said first resistive means is selected to produce a value of said first compensating current substantially equivalent to said first current.

6. The regulated voltage supply as set forth in claim 5 wherein said amplifier first input comprises a positive input and said amplifier second input comprises a negative input.

7. The regulated voltage supply as set forth in claim 6 wherein said amplifier means includes a power supply to provide a return path for said first and second compensating current.

8. In a regulated power supply having a voltage reference source for generating a reference voltage and sense lead means connected to a load for measuring a load voltage magnitude; and the power supply, in response, controlling an output voltage applied to the load, wherein sense current in the sense lead means caused by any difference between the load and reference source voltages tends to induce load voltage magnitude error, a method of reducing said error comprising the steps of sensing current in the sense lead means and in response generating in the sense lead means a compensating current substantially equal in magnitude and opposite in direction to the sense current.

9. A regulated voltage supply comprising:

a. a reference voltage source for generating a reference voltage;

b. regulator means for controlling an output voltage across a load;

c. first and second sense leads operatively connected between opposite ends of said load and said regulator means, respectively, said first and second sense leads establishing, respectively, first and second conductive paths, first and second sense currents caused by any difference between the output voltage and the reference voltage flowing, respectively, in said first and second paths;

d. means for measuring the first and second sense currents; and e. current means for generating a compensating current through a third conductive path in circuit with said first and second conductive paths, said compensating current being substantially equal to a sum of said first and second sense currents.

* * * * *